United States Patent [19]

Ward

[11] Patent Number: 5,048,243

[45] Date of Patent: Sep. 17, 1991

[54] EARTHQUAKE RESTRAINT MECHANISM

[76] Inventor: John D. Ward, 3640 Cincinnati, Rocklin, Calif. 95677

[21] Appl. No.: 258,359

[22] Filed: Oct. 17, 1988

Related U.S. Application Data

[63] Continuation-in-part of Ser. No. 167,062, Mar. 11, 1988, abandoned.

[51] Int. Cl.[5] ..... E04B 1/98

[52] U.S. Cl. ..... 52/167 R; 52/584; 52/745

[58] Field of Search ..... 52/167, 573, 226, 583, 52/584, 745

[56] References Cited

U.S. PATENT DOCUMENTS

| | | | |
|---|---|---|---|
| 1,303,022 | 5/1919 | Brown . | |
| 1,587,803 | 6/1926 | Sprigg | 52/282 |
| 1,891,513 | 12/1932 | Venzie . | |
| 2,035,143 | 3/1936 | Cavaglieri . | |
| 2,690,074 | 9/1954 | Jones . | |
| 3,462,908 | 8/1969 | Wysocki . | |
| 3,627,107 | 6/1972 | Santry . | |
| 3,851,428 | 12/1974 | Shuart | 52/573 |
| 4,327,241 | 4/1982 | Obenchain . | |
| 4,483,109 | 11/1984 | MacDonald . | |

*Primary Examiner*—John E. Murtagh

*Attorney, Agent, or Firm*—Townsend and Townsend

[57] ABSTRACT

An earthquake restraint mechanism helps to prevent the collapse of tilt-up style exterior wall panels (7, 64) of a building (17). The panels are coupled to one another at their abutting joints (16) through L-shaped brackets (18, 20, 68) mounted to the wall panels and restrainers (32, 66, 106) connecting the outwardly extending legs (28, 30, 90) of the brackets. The panels are energetically coupled to one another because the brackets act as shock absorbers which absorb the initial shock on the all panels from an earthquake. Because the panels are tied together, the panels are restrained from collapsing thus helping to protect persons and property. An accumulative effect of energy absorption is evident with the redundant use of the restraint mechanism. The panels can also be connected to other structural members, such as joists or beams, as well.

9 Claims, 4 Drawing Sheets

EARTHQUAKE RESTRAINT MECHANISM

This is a continuation-in-part of U.S. patent application Ser. No. 07/167,062, filed Mar. 11, 1988, now abandoned.

BACKGROUND OF THE INVENTION

One common type of industrial building is called a tilt-up building because of the construction technique used to build them. These buildings are usually one story, up to eighteen or twenty feet high, and have a slab foundation. The external concrete walls are made by placing a form on the slab foundation pouring concrete into the form and, after set, tilting up the concrete panel and securing the wall panels in place. The abutting side edges of adjacent panels are commonly joined together in the following manner. Mounting plates are cast into the concrete wall panel on the inside face of the wall panels at the edge of each panel joint. A connecting plate is then welded to the cast-in mounting plates to rigidly secure the wall panels to one another across the joints.

Tilt-up buildings have become very popular because of their relative low cost and ease of construction. However, during earthquakes the rigidly secured joint plates are subject to failure which allows the wall panels to fall outward, inward or both, thus posing a serious danger to persons and property.

SUMMARY OF THE INVENTION

The invention is directed to an earthquake restraint mechanism and method for use with tilt up type buildings to help prevent the external wall panels from collapsing during an earthquake. The mechanism employs restrainer assemblies to join the wall panels to one another. The restrainer assemblies include restrainer mounts and coupling members.

The restrainer mounts, typically L-shaped brackets, are secured to the wall panels. The restrainer mounts are preferably secured to the inside face of the panels near their upper corners. The restrainer mounts are connected together by a suitable coupling member, such as a strong, flexible cable which provides a tension restrainer. The coupling member can also provide restraint in compression and tension, such as by the use of coaxial restrainer members with the inner providing tension restraint and the outer providing compression restraint. The restrainer mounts and coupling members are adapted so the initial shock is absorbed or taken up by the restrainer assemblies. Several restrainer assemblies on different structural members of the building can take up much of the seismic load and prevent the load from being concentrated on one panel. This creates an accumulative effect of energy absorption.

In this application the wall panels are said to be energetically coupled to one another because of this property of the restrainer mounts and the coupling member. The energetic coupling can be primarily resilient, primarily damped or a combination of the two.

The energetic coupling in the preferred embodiments is provided primarily by the outwardly extending legs of the brackets which act as shock absorbers. The use of L-brackets to provide the majority of the energetic coupling accomplishes the task with simple, relatively inexpensive and commercially available hardware.

The L-brackets may simply be bolted, or otherwise fastened directly to the adjacent wall panels. The L-brackets can also be used in conjunction with restrainer plates positioned on either side of the wall panels. The restrainer plates are preferably slotted so as not to inhibit the movement of abutting wall panels in the plane defined by the wall panels. The restrainer assemblies do this. However, the restrainer plates help to keep the wall panels from moving in other directions relative to one another. By using a restrainer plate in the form of a U-channel and positioning one leg of the brackets between the legs of the U-channel, twisting of the L-brackets is prevented. The U-channels also help to keep the wall panels, and other structural members, in their proper positions relative to one another to further help prevent structural collapse regardless of how the panels and other structural members move.

During an earthquake, or other catastrophic event such as an explosion inside or outside the building, the invention helps prevent the wall panels from collapsing, even if the rigid joint plates connecting the walls along their abutting side edges may fracture when the building is subjected to such a large external force. The present invention primarily seeks to prevent injury to people and damage to property caused by the wall panels falling. Although prevention of damage to the building is not a primary aspect of the invention, the invention may, depending upon the circumstances, help to lessen the damage to the building as well.

The invention can be used with existing buildings so long as access for mounting the restrainer assemblies is available. A primary field of application of the invention is for retrofitting existing buildings because of the large number of tilt up buildings in existence. For maximum efficiency the restrainer assemblies are preferably mounted near the upper edge of the wall panels. If desired more than one set of restrainer assemblies may be used along any one wall joint. Although the restrainer assembly is preferably mounted on the inside faces of the wall panels, primarily for esthetic reasons, they could be mounted to the external faces of the wall panels as well.

Many buildings have large cut outs in the wall panels for windows and doors. The invention can help keep these modified wall panels from collapsing sideways as well as inward or outward.

Other features and advantages of the present invention will appear from the following description in which the preferred embodiments have has been set forth in detail in conjunction with the accompanying drawings.

DETAILED DESCRIPTION OF THE PREFERRED EMBODIMENTS

Figure 1:
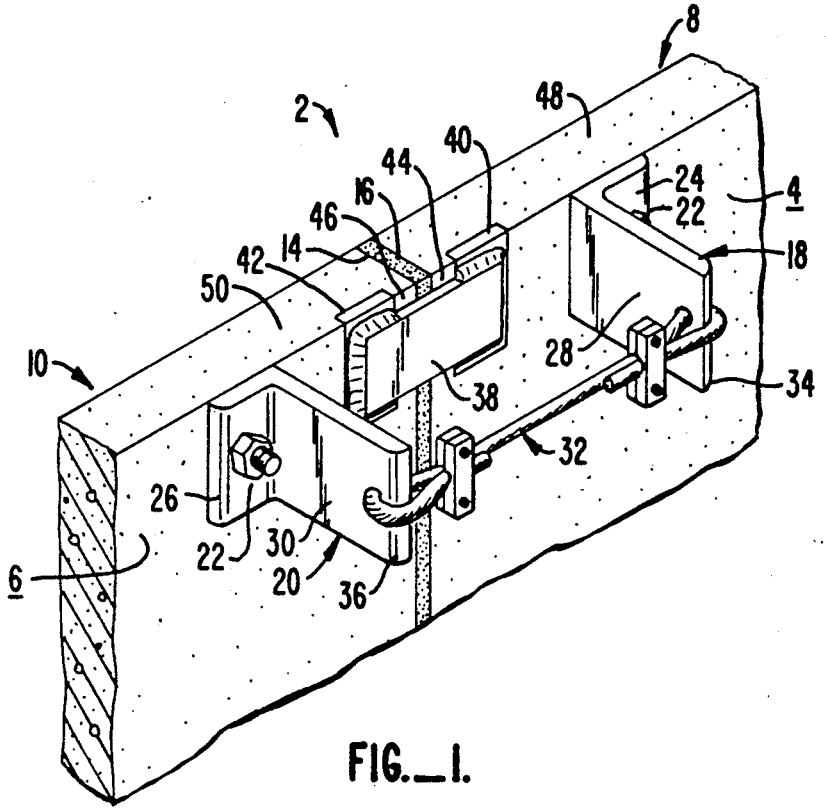
FIG. 1 is an isometric top view showing a restrainer assembly made according to the invention mounted to abutting wall panels.
Figure 2:
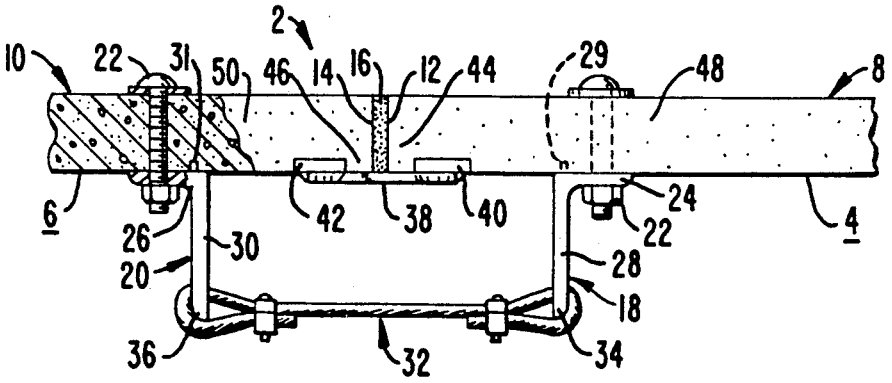
FIG. 2 is a top view of the restrainer assembly of FIG. 1.
Figure 3:
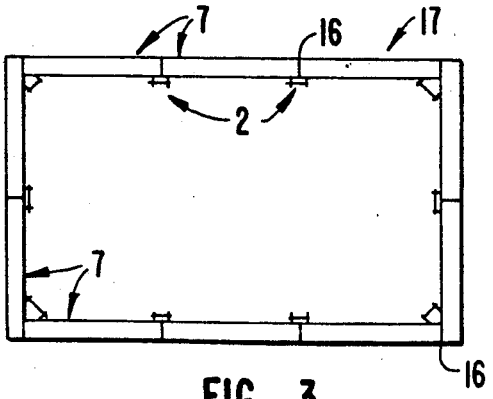
FIG. 3 is a schematic representation of a tilt-up building illustrating how each of the wall panels are tied to one another along a joint by restrainer assemblies of FIG. 1.

Referring now to FIGS. 1-3, a restrainer assembly 2 is shown mounted to the inside faces 4, 6 of two abutting tilt-up wall panels 8, 10. Panels 8, 10 have abutting side edges 12, 14 which form a wall joint 16. Restrainer assemblies 2 are preferably positioned at each wall joint 16 between panels 7 of the building 17.

Restrainer assembly 2 includes L-shaped brackets 18, 20, secured to inside faces 4, 6 by nut and bolt assemblies 22, and a strong cable coupler or restrainer 32 coupling brackets 10, 20.

Brackets 18, 20 include first legs 24, 26 adjacent inside faces 4, 6 and second legs 28, 30 extending away from the inside faces. Cable restrainer 32 connects the outer ends 34, 36 of legs 28, 30 to one another. Brackets 18, 20 also include register pins 29, 31 which extend into wall panels 8, 10. Register pins 29, 31 help to keep brackets 18, 20 from twisting about nut and bolt assemblies 22 during an earthquake to keep legs 28, 30 properly oriented relative to one another. If brackets 18, 20 were to twist about nut and bolt assemblies 22, the energetic coupling created by the brackets would be changed since the brackets would likely be stiffer. In addition, if brackets 18, 20 were to twist abut nut and bolt assemblies 22, the force on legs 28, 30 would tend to place nut and bolt assemblies 22 in a combination of tension and shear. In contrast, keeping brackets 18, 20 properly oriented will tend to place nut and bolt assemblies 22 primarily in tension, rather than in a combination of tension and shear.

Wall joint 16 is kept together by a conventional joint plate 38 welded to cast-in mounting plates 40, 42 on either side of joint 16. During an earthquake, or other catastrophic event, joint plates 38, being rigidly secured to mounting plates 40, 42, tend to fail, after which wall panels 8, 10 may collapse. (The interior framework of the building may or may not prevent the wall panels from collapsing inward.) However, by coupling all of the wall panels of building 17 to one another, as shown in FIG. 3, the wall panels are prevented from collapsing so to protect persons and property which would otherwise be struck by the falling wall panels.

In use, L-shaped brackets 18, 20 are mounted to inside wall faces 4, 6 near the upper corners, 44, 46, that is near both side edges 12, 14 and upper edges 48, 50 of wall panels 8, 10. Brackets 18, 20 are secured to one another at the outer ends 34, 36 of second legs 28, 30 by cable restrainers 32. Restrainer assemblies 2, during an earthquake, will help prevent the collapse of wall panels 7 by energetically coupling all of the wall panels to one another.

L-shaped brackets 18, 20 act as shock absorbers and provide energetic coupling for restrainer assembly 2. This energetic coupling is primarily resilient, in this embodiment. However, the energetic coupling could be primarily damped or a combination of resilient and damped coupling. Also, cable restrainer 32 could be modified to incorporate the energetic coupling aspect of the invention. Although it is considered that only a single restrainer assembly 2 will be needed at each joint 16, more than one restrainer assembly 2 may be used as well.

Brackets 18, 20 and cable restrainers 32 can also be used to tie wall panels 7 to other structural members, such as beams or joists; the brackets would act as shock absorbers to energetically couple the wall panels and structural members to catch or hold the roof or floor, and vice versa.

Figure 4:
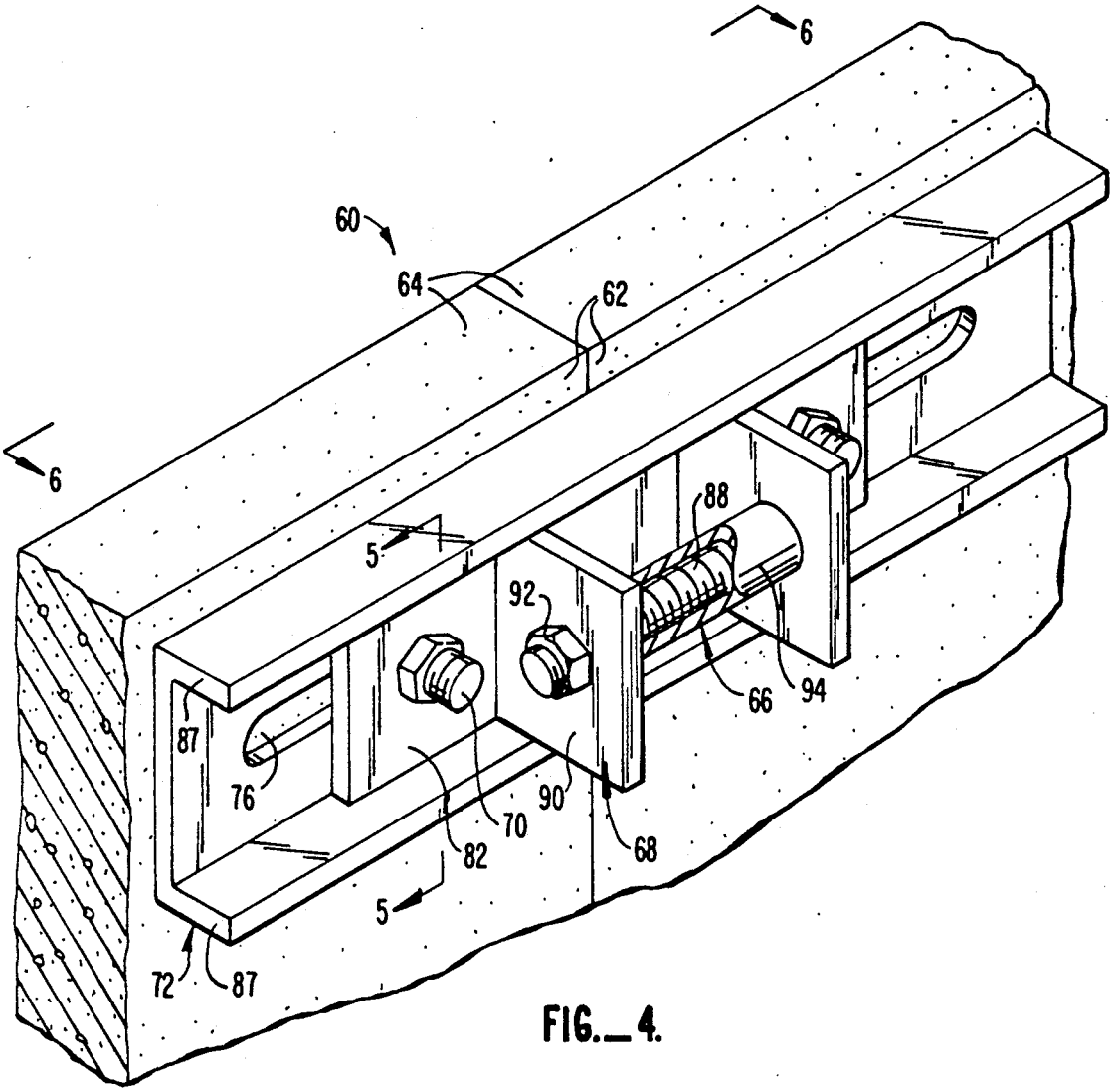
FIG. 4 is an isometric top view showing an alternative embodiment of the restrainer assembly of FIG. 1.
Figure 5:
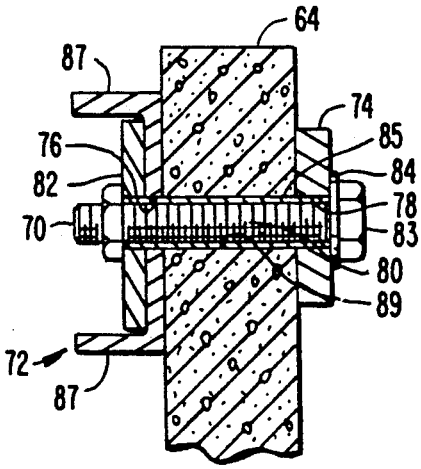
FIG. 5 is a cross-sectional view taken along line 5—5 of FIG. 4 showing the sleeve surrounding the bolt and providing the bearing surface upon which the restrainer rides.
Figure 6:
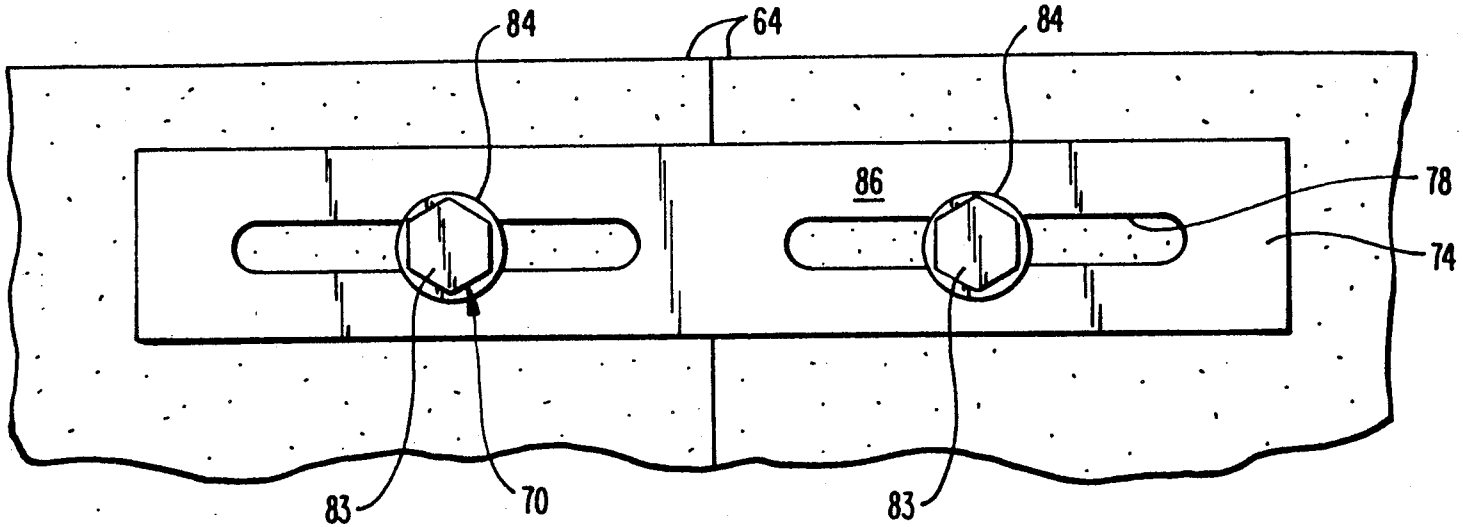
FIG. 6 is a back plan view showing the outer alignment plate of the restrainer assembly of FIG. 4 as seen along line 6—6 of FIG. 4.

Turning now to FIGS. 4 and 5, a restrainer assembly 60 is shown mounted to near the top corners 62 of adjacent wall panels 64. Restrainer assembly 60 includes a tension/compression restrainer 66 mounted to a pair of L-brackets 68. L-brackets 68 are secured to wall panel 64 through the use of nut and bolt assembly 70, a U-shaped, inner alignment plate 72 and a flat outer alignment plate 74. Plates 72, 74 both have elongate slots 76, 78 through which the shanks 80 of assemblies 70 pass. Shanks 80 also pass through appropriately placed holes in the inner legs 82 of L-brackets 68. Nut and bolt assemblies 70 include an enlarged head 83, and a slide nut or washer 84 adjacent head 83 which rests against the outer surface 86 of plate 74. Assemblies 70 each include a sleeve 85 surrounding each shank 80. Wall panels 64 have holes 89 formed through them; holes 89 are sized to provide a close fit with sleeves 85. The shear strength of each nut and bolt assembly 70 is increased by the use of sleeve 85. It is primarily sleeve 85 which resists the shearing forces on assemblies 70; shanks 80 primarily hold plates 72, 74 together. Sleeve 85 provides the bearing surface for the movement of plates 72 and 74.

The outwardly extending legs 87 of U-plate 72 are separated by a distance sufficiently wide to keep L-brackets 68 from pivoting during movement in plate 72. This helps to keep L-brackets 68 properly positioned so that the forces on L-bracket 68 and restrainer 66 can be controlled as to direction and type.

Tension/compression restrainer 66 includes an inner threaded rod 88 secured to the outwardly extending legs 90 of L-bracket 68 by nuts 92. Restrainer 66 also includes a sleeve 94 through which rod 88 passes and positioned between legs 90 of L-bracket 68. By this arrangement rod 88 resists separation of L-brackets 68, typically placing rod 88 in tension while sleeve 94 resists movement of L-bracket 68 towards one another by placing sleeve 94 in compression.

Figure 7:
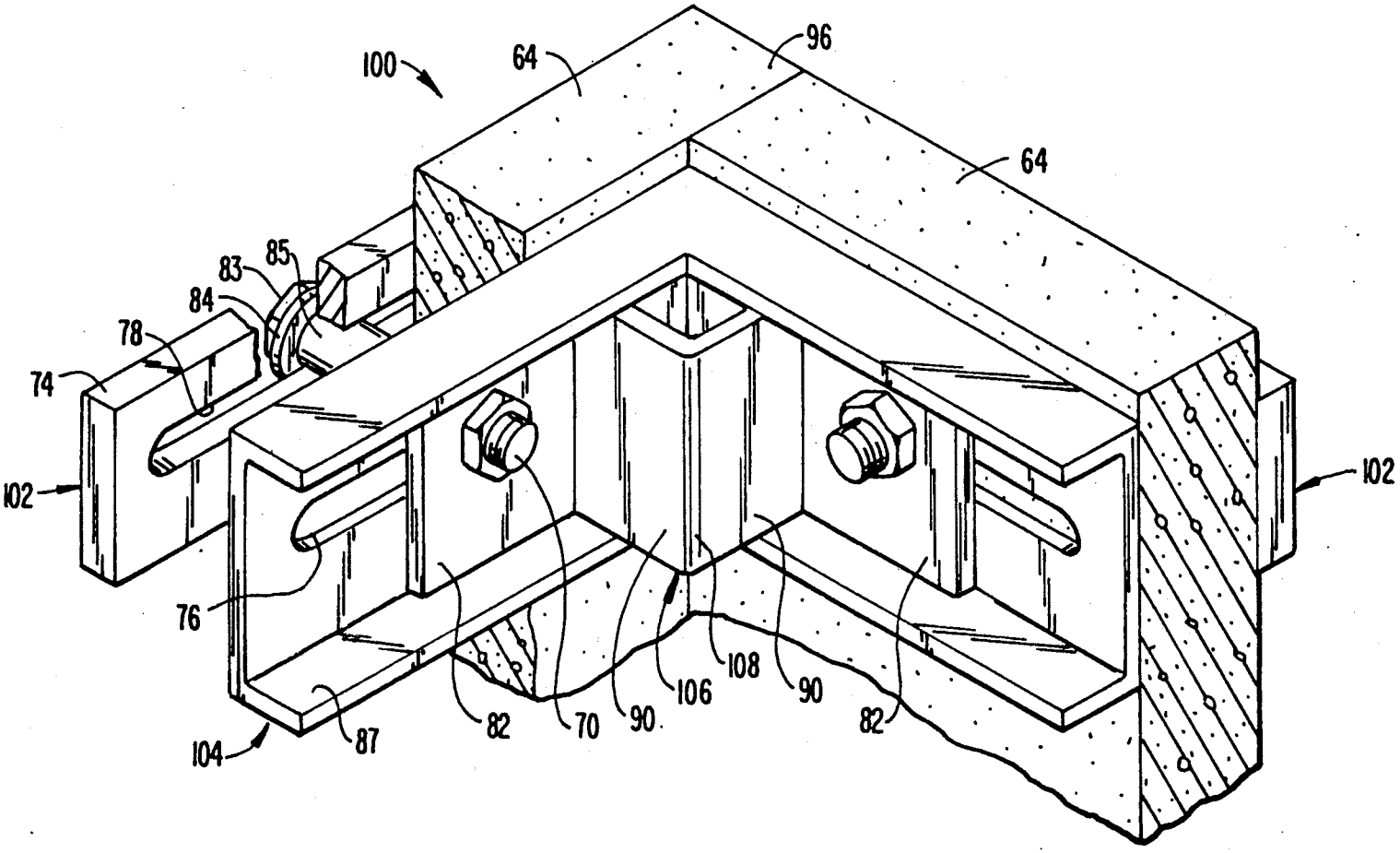
FIG. 7 is an isometric top view showing an alternative embodiment of the restrainer assembly of FIG. 4 adapted for use at a corner.

FIG. 7 illustrates an alternative embodiment of the restrainer assembly 60 of FIG. 4 configured for use at a corner 96. Restrainer assembly 100 is similar to restrainer assembly 60 in basic construction with like features identified with like reference numerals. However, outer alignment plate 102 and U shaped, inner alignment plate 104 have longitudinal L-shapes, rather than being straight as in the embodiment of FIG. 4, but otherwise are similar in construction. Also, tension/compression restrainer 66 of the FIG. 4 embodiment has been replaced by joining the outer ends of the outwardly extending legs of the L-shaped brackets of FIG. 4 at a joint 108 to create a W-shaped bracket 106. Restrainer assembly 100 forms the same sort of energetic coupling as restrainer assembly 60 but modified somewhat because of the configuration at corner 96.

Other modifications and variations can be made to the disclosed embodiments without departing from the subject of the invention as defined in the following claims. For example, it is preferred that all wall panels 7 be connected to one another. In some cases it may not be necessary or possible to do so, such as when the building has three walls and one open side.

What is claimed is:

1. An earthquake restraint mechanism, for use with buildings of the type having structural members, the structural members including a plurality of wall panels, the wall panels having first surfaces, second surfaces, side edges and upper edges, the wall panels being mounted with the side edges of wall panels adjacent other wall panels, comprising:

a restrainer assembly coupling a first of the wall panels to an adjacent, second wall panel, the restrainer assembly including:

a first restrainer mount secured to the first wall panel and a second restrainer mount secured to the second wall panel;

a restrainer coupling the first and second restrainer mounts;

at least one of the restrainer and restrainer mounts including panel to panel shock absorbing structure;

first and second alignment plates positioned against the first and second surfaces of the first and second wall panels, the first and second alignment plates including through holes;

fastening elements passing through the through holes in the first and second alignment plates and passing through the first and second wall panels;

the first and second restrainer mounts secured to the first alignment plate by the fastening elements, the fastening elements and alignment plates adapted to permit movement of the wall panels in a plane defined by the wall panels but to inhibit other movement of the wall panels;

whereby the restrainer assembly helps keep the first wall panel and the second wall panel from falling down after the building has been subjected to an external force.

2. The restraint mechanism of claim 1 further comprising sleeve means, surrounding the fastening elements, for creating bearing surfaces between the fastening elements and the wall panels.

3. The restraint mechanism of claim 1 wherein the first and second wall panels define a flat plane.

4. The restraint mechanism of claim 1 wherein the first and second restraint mounts include L-shaped brackets which act as at least a portion of the shock absorbing structure.

5. The restraint mechanism of claim 4 wherein the first alignment plate has a U-shaped cross-sectional shape with legs facing away from the first surfaces of the first and second wall panels, the L-shaped brackets having legs sized to fit between the legs of the U-shaped brackets from twisting about an axis perpendicular to the first surface of the adjacent wall panel.

6. The restraint mechanism of claim 1 wherein the through holes in the first and second alignment plates are longitudinally directed elongate slots.

7. An earthquake restraint mechanism, for use with buildings having tilt-up exterior wall panels mounted about the exterior perimeter of the building, the panels having side edges and top edges, the panels mounted side edge to side edge to define joints therebetween, comprising:

brackets, having first members mounted to wall panels on opposite sides of the joints and having second members extending away from said wall panels;

bolt means, passing through holes in the wall panels for securing the brackets to the wall panels;

sleeve means, surrounding the bolt means, for providing bearing surfaces between the bolt means and the wall panels;

means for restricting pivotal movement of the brackets relative to the wall panels;

means for connecting the second members of the brackets, located either side of wall joints, to one another; and at least one of the brackets and connecting means including shock absorber means for absorbing an initial seismic energy load on the wall panels so to help keep the adjacent side edges together and to help keep the wall panels from falling down.

8. A method, for use with a building having structural members, including wall panels, for helping to prevent the wall panels of the building from falling down due to a force applied to the building, comprising the following steps:

mounting support brackets to the structural members;

the mounting step including the steps of:

forming holes in the structural members;

inserting bearing surface sleeves into the holes; and inserting bolts into the sleeves; and energetically coupling wall panels to adjacent structural members through the support brackets so to tie said wall panels and adjacent structural members to one another thereby helping to keep the wall panels and the adjacent structural members from falling down due to the applied force.

9. A method for helping to prevent exterior wall panels of a tilt-up style building from falling down with the building is subjected to an applied force, such as an earthquake, comprising the following steps:

mounting support brackets to the wall panels near joints created between adjacent upper corners of the wall panels, the support brackets each including a shock absorbing extension extending away from the wall panels;

the mounting step includeing the steps of:

forming holes in the wall panels;

inserting bearing surface sleeves into the holes; and inserting bolts into the sleeves;

restricting pivotal movement the support brackets relative to the wall panels;

restraining movement to the adjacent wall panels to a plane defined by the adjacent wall panels;

resisting movement of the adjacent wall panels towards and away from one another by connecting the shock absorbing extensions on either side of the joints; and at least partially absorbing the initial impact of the applied force by the supports brackets.

* * * * *